US010373427B2

(12) United States Patent
Koll et al.

(10) Patent No.: US 10,373,427 B2
(45) Date of Patent: Aug. 6, 2019

(54) SYSTEM AND METHOD FOR VOLATILITY SMOOTHING AND ODDS ENFORCEMENT THROUGH MODIFIED WAGER/DRAW GENERATION

(71) Applicant: IGT Global Solutions Corporation, Providence, RI (US)

(72) Inventors: Aaron Michael Koll, Lincoln, CA (US); Sarah W. Simpkins, Warwick, RI (US); Bradford Heathcote, Chepachet, RI (US)

(73) Assignee: IGT, Las Vegas, NV (US)

( * ) Notice: Subject to any disclaimer, the term of this patent is extended or adjusted under 35 U.S.C. 154(b) by 677 days.

(21) Appl. No.: 15/099,711

(22) Filed: Apr. 15, 2016

(65) Prior Publication Data

US 2016/0307405 A1 Oct. 20, 2016

Related U.S. Application Data

(60) Provisional application No. 62/157,523, filed on May 6, 2015, provisional application No. 62/148,444, filed on Apr. 16, 2015.

(51) Int. Cl.
*G07F 17/32* (2006.01)

(52) U.S. Cl.
CPC ..... *G07F 17/3244* (2013.01); *G07F 17/3295* (2013.01)

(58) Field of Classification Search
CPC ..... G07F 17/3244; G07F 17/3295
See application file for complete search history.

(56) References Cited

U.S. PATENT DOCUMENTS

| | | | | |
|---|---|---|---|---|
| 5,673,914 | A * | 10/1997 | Sullivan | A63F 7/048 273/138.1 |
| 5,863,207 | A | 1/1999 | Powell | |
| 6,241,246 | B1 | 6/2001 | Guttin et al. | |
| 6,244,596 | B1 | 6/2001 | Kondratjuk | |
| 6,830,514 | B2 | 12/2004 | Meyer et al. | |
| 7,351,142 | B2 | 4/2008 | Walker et al. | |
| 7,407,437 | B2 | 8/2008 | Bozeman | |
| 7,497,778 | B2 | 3/2009 | Bozeman | |
| 7,510,116 | B2 | 3/2009 | Robb et al. | |
| 7,601,059 | B2 | 10/2009 | Bozeman | |
| 8,449,374 | B2 | 5/2013 | Meyer et al. | |
| 8,579,694 | B2 | 11/2013 | Odom et al. | |
| 2003/0201601 | A1 * | 10/2003 | Koopman | A63F 3/0423 273/146 |
| 2005/0059464 | A1 * | 3/2005 | Bozeman | G07F 17/32 463/18 |

(Continued)

*Primary Examiner* — Jason Skaarup
(74) *Attorney, Agent, or Firm* — Neal, Gerber & Eisenberg LLP

(57) ABSTRACT

Embodiments of a system and method provide game operators with effective deployment of word-based games that removes and/or manages much of the volatility associated therewith. In various embodiments, the system includes a remote central host that processes stored game details according to a method, wherein the method includes identifying potential game tickets for generation, evaluating possible ticket outcomes associated with the potential tickets, and establishing a group of acceptable wagers and a group of represented letter combinations, wherein letter combinations can be filtered out based on repeated occurrences.

22 Claims, 14 Drawing Sheets

(56) References Cited

U.S. PATENT DOCUMENTS

| | | | | |
|---|---|---|---|---|
| 2005/0059465 | A1* | 3/2005 | Bozeman | G07F 17/32 463/18 |
| 2005/0130734 | A1 | 6/2005 | Khayat | |
| 2006/0017224 | A1 | 1/2006 | Seidman | |
| 2006/0178192 | A1* | 8/2006 | Bozeman | G07F 17/32 463/17 |
| 2006/0252488 | A1 | 11/2006 | Lalonde | |
| 2009/0014955 | A1 | 1/2009 | Hindermann | |

* cited by examiner

FIG. 8

Instant Pay table

| Prize | Total | Prize Pool | Percent |
|---|---|---|---|
| **$1,000** | **85,000** | **$352,941** | **0.39%** |
| $500 | 42,857 | $350,000 | 0.39% |
| $100 | 16,667 | $180,000 | 0.20% |
| $50 | 4,286 | $350,000 | 0.39% |
| $30 | 1,714 | $525,000 | 0.58% |
| $20 | 1000 | $600,000 | 0.67% |
| $15 | 400 | $1,125,000 | 1.25% |
| $10 | 133 | $2,250,000 | 2.50% |
| $5 | 57 | $2,625,000 | 2.92% |
| $3 | 16 | $5,625,000 | 6.25% |
| Free Ticket | 10 | $5,250,000 | 5.83% |
| Overall | [illegible] | [illegible] | [illegible] |

78

FIG. 9

Draw Pay table

| Word Length | Odds 1 in | Prize Range | Average Prize | Payout |
|---|---|---|---|---|
| **All Words** | **2,939,300** | **$250,000** (Fixed) | **$250,000** (Fixed) | **2.84%** |
| 7 | 473.09 | $30 - $100 | $41 | 9.36% |
| 6 | 116.68 | $15 - $20 | $15 | 5.86% |
| 5 | 47.00 | $8 - $14 | $8 | 7.69% |
| 4 | 16.76 | $4 - $7 | $4 | 11.00% |
| 3 | 9.43 | $3.00 (Fixed) | $3.00 (Fixed) | 10.58% |
| Overall | [illegible] | | | [illegible] |
| [illegible] | [illegible] | | | [illegible] |

79

110

112

111

114

SYSTEM AND METHOD FOR VOLATILITY SMOOTHING AND ODDS ENFORCEMENT THROUGH MODIFIED WAGER/DRAW GENERATION

FIELD OF THE INVENTION

The present invention relates to wagering game systems, and more particularly to managing volatility in draw-based and/or instant game systems involving words.

BACKGROUND

Regulated wagering games are common throughout the world. Typical examples are games offered by state lotteries. These games, which are offered on a large scale, are operated using centralized transaction processing systems to collect and/or redeem wagers, execute software programming to randomly generate play indicia, and manage player and game information. Most state lotteries and similar entities operate their own central host system, or have it operated by a contractor such as IGT Global Solutions Corporation. The host systems are typically located within the jurisdiction of the lottery provider. The state lotteries also deploy their own client equipment to operate various channels for delivering games to player customers, such as agent-operated lottery game sales terminals, unattended lottery game sales terminals, vending machines, kiosks, electronic access via the Internet from personal computers, mobile phone access, and interactive TV terminal access, for example. They also operate, or have operated on their behalf by a contractor, their own customized administration systems, such as accounting, reporting, fraud control, loyalty programs and prize redemption systems, for example.

In various embodiments, these systems can include multiple servers providing interactive interfaces for receiving wager requests online, receiving loyalty program sign-up requests, processing and storing such requests, issuing wagering receipts, assigning player accounts, processing funds for player accounts, tracking player interaction with the system and performing other administrative functions. Various types of networks can be employed, including the Internet, in order to ensure proper system availability and minimized downtime for operation.

Lottery games of both the "instant win" and "future draw" type games are popular. They are found in state run and privately run lottery systems worldwide, and provide a significant source of income for government operators to generate revenues for public purposes such as education. Future draw lotteries, like Lotto™ or Powerball™ often have large prizes and appeal to players who purchase tickets on a regular schedule or with a group. Instant win tickets are most commonly sold as "scratch-off" tickets, where the game result is indicated by game play information concealed by a removable scratch-off layer. This layer can be removed by the player after the ticket is purchased to reveal the game outcome. Instant win tickets are popular in part because they allow a player to determine the prize value of their ticket immediately after purchase. Instant win tickets generally also have bright, attractive graphic schemes and are sold as eye-catching consumer items. Instant win tickets can also be generated by a terminal.

With respect to game themes and operative play mechanics, marking off letters in order to match words is a well-known theme in various gaming categories (e.g., Crossword, Word-Search, Wheel of Fortune™ style games, etc.). Despite the demonstrated and known appeal, however, game operators have not implemented a robust set of draw-based word games where, for example, a player's wager is a set of words, the game operator draws a series of letters, and prizes are awarded based upon which and how many words the player matches.

Part of the reason for the lack of game implementations of this fashion involve the inherent bias in words chosen at random that is not present in combinations of numbers chosen at random. Words chosen at random in word based games from the same "word group'" (e.g., three-letter words) do not always provide mathematically equivalent odds of winning given the award criteria (e.g., match the word provided against some letters drawn by the game operator). For example, if a drawing-based game involves six randomly selected numbers out of forty-nine, then a large amount of wagers generated in this fashion will have little statistical correlation with each other, and in the long run, each number will have approximately equal representation in the cumulative sample.

Words generated at random, however, will not provide approximately equal letter counts in the long run. For example, if the words generated at random are in English, there would be an expectation that many more E's and T's would appear in the words than, for example, U's and Z's. This presents a volatility issue for a game operator, in that prize awards would likely be clumped together much more heavily when based on word matches than they would be on random number matches. This payout volatility is often not logistically feasible for lotteries and other gaming operators whose draw liabilities could be very large.

Another reason for the lack of game implementations of this fashion is the lack of appealing packaging and/or hybrid games, such as tickets that have both an instant and a draw-based game component.

SUMMARY

Embodiments of the present invention provide, among other things, systems and methods to provide game operators with control over problematic game characteristics as described above, including providing game operators with effective deployment of word-based games that removes and/or manages much of the volatility associated therewith. Embodiments of the present invention also provide for various packaging and hybrid instant-plus-draw-based games. In aspects, the present invention incorporates a system and process steps designed to remove or minimize the variance in the expected return to a player for each wager.

BRIEF DESCRIPTION OF THE DRAWINGS

FIGS. 8 and 9 show exemplary prize pay tables as part of games associated with the present invention.

DETAILED DESCRIPTION OF EMBODIMENTS

Figure 1:
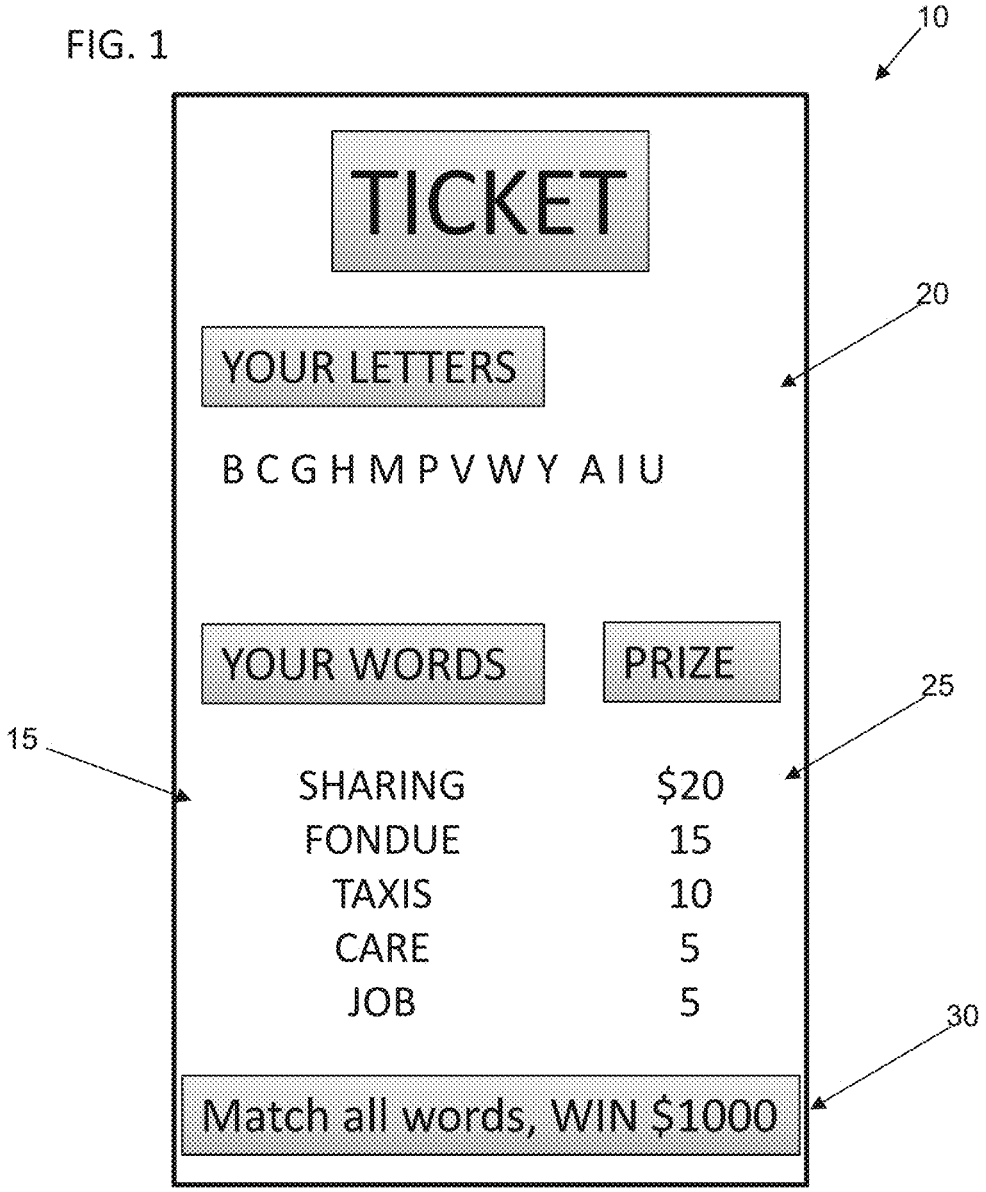
FIG. 1 shows an example ticket for a word-based game.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

It will be appreciated that the embodiments of the system and method described below can be applied to a number of word-based games, despite its representation in a specific example. In the example ticket 10 shown in FIG. 1, assume that when a player places a wager, he/she receives a ticket with a:

7 letter word
6 letter word
5 letter word
4 letter word
3 letter word

It will further be appreciated that the "ticket" can be a physical ticket with words printed on a substrate and with or without a scratch-off covering thereon (e.g., as in a traditional instant win ticket), or the ticket can also be an electronically displayed ticket viewable through a user interface display of an electronic device, for example.

Regardless, the words on the ticket can be randomly selected by a game host computer system operating in accordance with the present invention, where programming randomly selects the words from some established dictionary (e.g., a subset of the English dictionary with unacceptable words removed) made available to the host (e.g., in system storage or accessed as an external resource). In this example, it will be appreciated that the number of words and length of the words can vary and are specified here only for clarity in demonstration.

In order to determine whether the ticket is a winner, there must be a basis for comparing the words on the ticket with game-determined winning words or letters. In various embodiments, the game host computer system randomly determines letters to be used to see if a full word on the ticket can be spelled using the randomly drawn game letters. As a specific example, FIG. 1 shows a ticket 10 with pre-printed player words 15 on the ticket, including "job", "care", "taxis", "fondue" and "sharing", and associated prizes for matching each word at 25. The randomly drawn game letters 20 are shown as a, b, c, g, h, i, m, p, u, v, w, and y. In such a case, none of the player words would be fully spelled using the randomly drawn letters, and assuming the game rules dictate that no winnings are awarded in the event there are zero matches, the player would not win in this instance. It will be appreciated that, while FIG. 1 shows a ticket with pre-printed randomly drawn game letters, embodiments of the present invention operate where the randomly drawn letters are not printed on the ticket, but are rather separately/randomly determined "future draw" letters that can be compared to the words printed on the ticket.

In various embodiments, the game operator will have a specific number of drawn letters for each game. In specific embodiments, the game operator can have a specific number of vowels and a specific number of consonants, chosen without replacement. It will be appreciated that the game host computer system can be established such that the number and breakdown (i.e., vowels and consonants) of randomly selected letters will be chosen strategically in order to generate a game odds profile appropriate for the game's participating population.

In various embodiments, for each word matched completely by the player with the letters drawn by the game operator, the player wins a corresponding prize 25. In various embodiments, the top prize is awarded to a player who matches all of the words on the ticket, as indicated at 30 in FIG. 1. In various other embodiments, prizes can be awarded based on matching various word subsets (e.g., top two words, first and last, etc.).

It will be appreciated that if the player words are selected entirely at random, and the game operator letters are selected at random from all possible letter combinations, there will be an unacceptable amount of volatility. For example, suppose game operator draw #1 is QWBVCXLKJ-IOU and game operator draw #2 is RSTMNLPCD-AEI. In such an example, the game operator may have an expected payout for draw #2 which is orders of magnitude above the expected payout for draw #1, owing to the much larger volume of English words which can be made with the letters in draw #2. Additionally, if the player words are selected at random, some tickets will be more likely to win prizes than others. For example, although the word "BEE" and the word "CAR" are both three-letter words, it is much easier to match "BEE" given that the "E" appears twice, thereby only requiring the matching of one consonant and one vowel in order to win, whereas the word "CAR" requires matching two consonants and one vowel. It will be appreciated that if the top prize is awarded to players who match all of the words on their ticket, players whose words have many letters shared amongst the ticket's words have a statistically easier time matching the game operator drawn letters than players with few or no overlapping letters.

As can be appreciated based on the above discussion, a fundamental problem in this environment is that words generated at random "clump" together such that some letter combinations drawn at random result in far greater word matches than others. Thus, the game operator can be subjected to large swings in payouts, which is undesirable for both the game operator and players, and which has proven to be a reason why no robust word-based games tied to random letter drawings have been developed or marketed.

Figure 2:
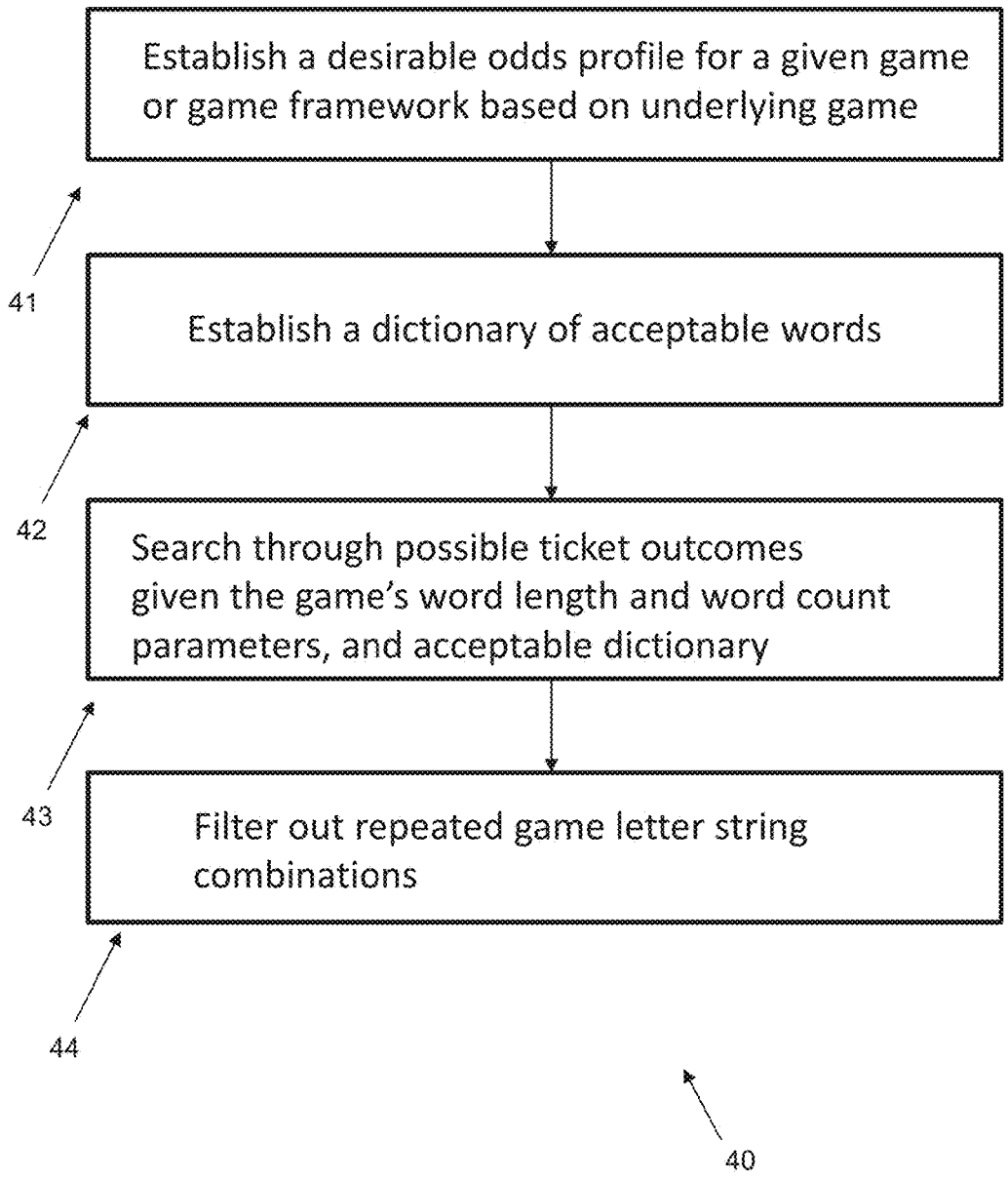
FIG. 2 shows method steps according to one embodiment of the present invention.

In various embodiments, and among other things, the present invention provides a volatility smoothing system and methodology that produces player words which are much farther apart in terms of their letter overlaps than what would be produced by selecting words at random. In various embodiments, a method associated with the present invention operates as shown at 40 in FIG. 2 so as to:

(1) Establish a desirable odds profile for a given game or game framework based on underlying game details, as at step 41;

(2) Establish a dictionary of acceptable words, as at step 42;

(3) Search through all (or a very large number) of possible ticket outcomes given the game's word length and word count parameters, and acceptable dictionary, wherein the ticket outcome pertains to whether the ticket is a winner or loser and the ticket prize liability if the ticket is a winner, as at step 43; and (4) Filter out repeated game letter string combinations, where the game letters are the randomly drawn letters used by players in an effort to match the players' words on their individual tickets, as at step 44.

It will be appreciated that steps 41 and 42 assist in developing a well-designed (for a given population) game, and steps 43 and 44 assist in generating an operationally feasible game, in terms of both managing the payout volatility and making sure that each wager is relatively equitable to every other wager.

With regard to step 41, embodiments of the present invention define a desirable odds profile for the above game framework based on the underlying game construction. For example, the game host computer system can calculate the odds profile for the game considering such parameters as:

a. How many words are provided in each wager b. How long each respective word is c. The allowable count of vowels and consonants in each word d. The allowable count of vowels and consonants in the words when considered as one larger string of letters (which can be required for the top prize match)

With regard to step 42, embodiments of the present invention then establish a dictionary of acceptable words. For example, vulgar words can be removed.

With regard to step 43, embodiments of the present invention next loop through all (or optionally a very large number of) possible ticket outcomes given the game's word length/count parameters and acceptable dictionary. For example, Table 1 below illustrates groups of words on two tickets that are theoretically possible for a word-based game:

TABLE 1

| | Potential Ticket 1 | Potential Ticket 2 |
|---|---|---|
| 7 Letter Word | hostess | bellboy |
| 6 Letter Word | thesis | newark |
| 5 Letter Word | slate | truck |
| 4 Letter Word | bump | onus |
| 3 Letter Word | use | fir |

In the above example, there are several potentially undesirable characteristics. For instance, one potentially undesirable characteristic is that the first ticket has a total of twelve distinct letters (abehilmopstu) and the second a total of sixteen (abcefiklnorstuwy). Given that the top prize is based on matching all words, the first ticket will be much more likely to win. Another lack of equality between the two tickets is present in the words themselves. For example, the three-letter word in the first ticket word has one unique consonant and two unique vowels, versus the two unique consonants and one unique vowel in the three-letter word in the second ticket. Thus, the three-letter word on Ticket 1 is more likely to be matched than the three-letter word on Ticket 2. For a given game design or game operator, this would very likely be an undesirable and/or unacceptable characteristic.

Thus, in embodiments of the present invention, step 43 also removes potential tickets, which step can be performed based on a number of criteria, such as, for example:

Total count of unique consonants among all words in the potential ticket

Total count of unique vowels among all words in the potential ticket

For example, tickets can be determined to only be acceptable if they have a total of nine unique consonants and three unique vowels among all player words. This ensures that the top prize odds are the same for every ticket.

For each word category, (i.e., seven-letter word, six-letter word, etc.), the total count of unique consonants and total count of unique vowels for that category.

For example, for four-letter words FIRE (two consonants and two vowels) and BRIM (three consonants and one vowel) can be deemed acceptable but perhaps BOOK is not (two consonants and one vowel) given that it much easier to match against a random lottery drawing. In another implementation, it will be appreciated that just one combination is allowed in order to make sure every ticket has the same probability of winning that division. Such an implementation will be appreciated as just one of many parameters that can be implemented or not implemented in accordance with various embodiments of the present invention.

Although step 43 ensures that the universe of potential tickets have a desirable (and equitable) odds profile relative to a random drawing by a game operator, the problem of payout volatility likely still persists. When game operator drawings contain common letters like T, R, S, or E, there can be orders of magnitude more winners than a drawing containing less common letters like P, Q, K, or U. In various embodiments of the present invention, step 44 of the method can operate to control this volatility. For this step, two computational tables can be envisioned and/or employed, both of which are initially empty: (a) an "AcceptableWager" table which will contain all of the tickets which will make it through the evaluation as acceptable potential wagers, and (b) a "RepresentedLetters" table which contains a listing of the letters which have been used in the previously identified acceptable wagers.

For each ticket which has passed step 43 above, the unique letters present amongst all the words are recorded in a table. For example, in Ticket 1 above the letters would be "abehilmopstu". A check is done in the RepresentedLetters table to see if this grouping of letters is present. If it is, the wager is not processed with such letters (i.e., it is rejected) and neither table is updated. If it is not, the RepresentedLetters table is updated to contain abehilmopstu. Additionally, the AcceptableWager table is updated to include Ticket 1. It will be appreciated that embodiments of the present invention can operate such that multiple instances of letter combinations can be permitted, and can be restricted (e.g., three instances of the same acceptable wager letters).

The tickets resulting from this process have important characteristics. For example, if the total count of unique consonants/vowels that the methodology has required for an acceptable ticket is equal to the total count of unique consonants/vowels that have been established for the game operator drawing, then only one ticket can win the top prize per drawing (subject to exceptions permitting multiple instances of letter combinations). This is an important step in minimizing the payout volatility. Whether the drawing consists of the most common consonants/vowels or the least common, at most one top prize winner per drawing is possible. Further, if the total count of unique consonants/vowels that the methodology has required as an acceptable ticket is less than the total count of unique consonants/vowels that have been established for the game operator drawing, then it is possible to have more than one winner per drawing. However, the process as described above helps maintain more "distance" between the tickets (in the sense of letter overlaps), which thereby reduces volatility.

As a result of the above steps, embodiments of the present invention can provide a carefully selected universe of tickets which can then be provided to players as wagers. The first player to purchase a ticket is randomly given a wager from the AcceptableWager table. The second player to purchase a ticket is randomly given a ticket from the table other than the one given to the first player. Continuing on in this fashion, so long as the potential tickets for the draw exceed requested wagers, volatility is minimized and managed by creating a situation where only one ticket can win the top prize (subject to the above assumptions). It will be appreciated that these specially chosen wagers have, by construction, several advantages over words chosen at random. For instance, at most one top prize will be awarded per draw (under the above assumptions). Further, two tickets selected at random will have fewer common letters among the player words than if the player words had been randomly selected, thereby minimizing volatility. Additionally, two tickets selected at random will have equivalent (or similar) odds profiles for each player word (controlled by the system's parameters), as opposed to what might occur with randomly selected words.

As specific examples of the above process, consider that a first potential wager developed from step 43 includes five player words, including a three-letter word, a four-letter word, a five-letter word, a six-letter word and a seven-letter word as follows: ('bid', 'calf', 'after', 'charge', 'fragile'). In this example, the total unique letters used across this ticket are: abcdefghilrt. Since no tickets/wagers with acceptable words and letters have been processed in the initial run, the RepresentedLetters and AcceptableWagers tables of step 44 are both empty. As such, the wager gets added to the AcceptableWager table, and the RepresentedLetters table is updated with these letters used.

Next, assume that the next potential wager from step 43 is: ('car', 'chef', 'grade', 'bridge', 'recital'). This potential ticket/wager has the same total unique letters as the first, i.e., abcdefghilrt. Systems and methods according to embodiments of the present invention will check the RepresentedLetters table, which will show that this exact letter composition has already been used. Thus, even though this ticket was composed of different words, the ticket will be rejected according to this operation of this embodiment of the present invention (although, in other embodiments where multiple instances of the same letters are permissible, this example would not be rejected). Accordingly, the game operator host computer system will not update either table. If the next potential ticket/wager from step 43 is: ('bad', 'cart', 'glare', 'breach', 'default'), the total unique letters used across this ticket are: abcdefghlrtu, and the system will check this combination against the RepresentedLetters table and determine that this exact letter composition is not yet used. As such, the RepresentedLetters table will be updated by the system with this group of letters and the AcceptableWager table will be updated by the system with this ticket/wager.

As a more comprehensive example, Table 2 below shows an example sequence of word combinations which passed step 43 given a set of criteria from a hypothetical gaming operator. Noted is whether or not each wager would then be rejected or accepted in step 44.

TABLE 2

| Potential Wagers | Wager Details | Letters Used | Accepted or Rejected |
|---|---|---|---|
| Potential Wager 1 | ('bid', 'calf', 'after', 'charge', 'fragile') | abcdefghilrt | Accepted |
| Potential Wager 2 | ('car', 'chef', 'grade', 'bridge', 'recital') | abcdefghilrt | Rejected |
| Potential Wager 3 | ('bad', 'cart', 'glare', 'breach', 'default') | abcdefghlrtu | Accepted |
| Potential Wager 4 | ('hub', 'glad', 'cable', 'thread', 'default') | abcdefghlrtu | Rejected |
| Potential Wager 5 | ('car', 'surf', 'badge', 'phrase', 'surface') | abcdefghprsu | Accepted |
| Potential Wager 6 | ('beg', 'card', 'pedal', 'pickle', 'fragile') | abcdefgiklpr | Accepted |
| Potential Wager 7 | ('elk', 'card', 'tiger', 'bridge', 'fragile') | abcdefgiklrt | Accepted |

It will be appreciated that the step 44 process continues until an acceptable universe of potential wagers is then produced. In various embodiments, when a game operator draw pool is open for a drawing of this game, the total universe of potential wagers is shuffled. The first ticket/wager given to players for this draw can be the first wager in the shuffled acceptable wager list. The second ticket/wager can be the next wager in this same shuffled wager list. As such, there will be no repeated groups of letters until all of the (many) wagers have been issued. In this way, embodiments of the present invention operate to force a sort of spread (or "distance") amongst the wagers that is very different from what one would get if one merely randomly assigned words that passed step 43 above. This, in turn, reduces the win and payout volatility to an acceptable level for the gaming organization.

Table 3 below illustrates hypothetical acceptable tickets/wagers for a game employing exactly nine consonants and three vowels, where each combination of words comprises a different set/combination of consonants and vowels. It will be appreciated that variations of this limitation can be employed. For example, in various embodiments, the system and method can operate to permit duplication of consonant and vowel combinations, and even to restrict duplication of consonant and vowel combinations to more than one but fewer than a capped number, such as five, for example.

TABLE 3

| |
|---|
| ('box', 'veal', 'scoop', 'school', lacrosse') |
| ('old', 'iron', 'chill', 'junior', 'windmill') |
| ('wig', 'vase', 'angel', 'canine', 'magazine') |
| ('elk', 'zero', 'merge', 'oriole', 'shilling') |
| ('dew', 'skis', 'waist', 'vertex', 'tweezers') |

TABLE 3-continued

| |
|---|
| ('wax', 'visa', 'award', 'rested', 'skydive') |
| ('jet', 'roof', 'exist', 'strict', 'overtime') |
| ('six', 'file', 'grill', 'glossy', 'scribble') |
| ('six', 'gain', 'creek', 'sierra', 'cranberry') |
| ('wit', 'avid', 'adept', 'awhile', 'practical') |
| ('saw', 'axe', 'seven', 'assure', jewelry') |
| ('aft', 'wall', 'spout', 'outlaw', 'polygon') |
| ('soy', 'fade', 'macro', 'jersey', 'scarecrow') |
| ('key', 'cage', 'sunny', 'avenue', 'calvary') |
| ('jet', 'bear', 'steak', 'accrue', 'shelter') |
| ('can', 'pave', 'buddy', 'beauty', 'adjacent') |
| ('bog', 'afar', 'booth', 'tailor', 'whirlpool') |
| ('jaw', 'tear', 'amber', 'square', 'symmetry') |
| ('rap', 'dive', 'knead', 'remedy', 'appendix') |
| ('bug', 'tilt', 'quick', 'outing', 'cufflink') |
| ('pin', 'zone', 'spoon', 'tycoon', 'expertise') |
| ('sun', 'good', 'unify', 'nobody', 'diminish') |
| ('bad', 'fame', 'shade', 'advise', 'sideways') |
| ('doe', 'view', 'boost', 'slowly', 'possible') |
| ('leg', 'feel', 'tenor', 'finish', 'groceries') |
| ('few', 'peak', 'verge', 'voyage', 'flagpole') |
| ('pan', 'fail', 'banjo', 'living', 'bowling') |
| ('hoe', 'note', 'chute', 'reflex', 'turnover') |
| ('foe', 'reel', 'three', 'convoy', 'voucher') |
| ('fez', 'trot', 'curve', 'crunch', 'forceful') |
| ('set', 'nail', 'faint', 'typist, 'javelin') |
| ('lip', 'feet', 'jeans', 'twelve', 'ventilate') |
| ('how', 'role', 'fleet', 'twelve', 'uncover') |
| ('ran', 'bass', 'maybe', 'square', 'wednesday') |
| ('pan', 'rage', 'urban', 'apathy', 'banquet') |
| ('beg', 'hare', 'agent', 'expert', 'banquet') |
| ('foe', 'hour', 'femur', 'rumpus', 'unbroken') |
| ('hay', 'haze', 'metal', 'vacant', 'athletic') |
| ('nut', 'huge', 'never', 'peanut', 'banquet') |
| ('guy', 'ripe', 'berry', 'vertex', 'fixture') |
| ('fix', 'rage', 'merit', 'aspire', 'appetizer') |
| ('bow', 'bake', 'vocal', 'meadow', 'bookcase') |
| ('jog', 'cool', 'hedge', 'legend', 'hopeful') |
| ('hog', 'tour', 'quirk', 'fusion', 'nourish') |
| ('wit', 'reed', 'quirk', 'twenty', 'intrigue') |
| ('six', 'time', 'arise', 'pretty', 'frigate') |
| ('yak', 'fear', 'lever', 'pauper', 'upgrade') |
| ('oaf', 'look', 'exact', 'heckle', 'wealthy') |
| ('mob', 'dual', 'group', 'balsam, 'formula') |
| ('nap', 'beam', 'heavy', 'unable', 'pendulum') |

It will be appreciated that, in the above construct, the game operator drawing is made from the body of vowels and consonants without restriction. In other words, if the host computer system of the game operator is drawing three vowels and three consonants, then the drawing FGJAEO is equally like to appear as any other drawing, say for example ZXYIOU. This process will be appreciated and understood by players who are used to a similar mechanic with drawn numbers games (e.g., Lotto™). Game design considerations, however, may make this undesirable in terms of the implied game odds.

In a variant of the above described methods, a related but different process can be extended to the game operator drawing itself. Here, the universe of potential drawings is restricted. For example, the drawn letter combination RST-EIO might be excluded as it provides too many winners, and the drawn letter combination XYZ-IOU might be excluded as it provides too few winners. In embodiments of the present invention where this draw based restriction is employed, the above must be modified to only result in words which could be made with this restricted draw universe. Otherwise, the tickets would not have a chance to win certain prize levels.

As alluded to above, the tickets of the lottery game according to the present invention can be printed physical tickets, or can also be electronic tickets that are played using any of various electronic devices, including mobile communications devices (e.g., smart phones), personal computing devices (e.g., desktops, laptops), stand-alone video lottery terminals, retailer terminals and other known devices, for example. In one embodiment of the present invention, electronic tickets can be presented to the user of an electronic device over a network that is connected to a host computer that creates, issues, validates and/or redeems tickets using suitable programming stored in a memory thereof and operable via a computer processor maintained within the host. The player's electronic device also includes suitable programming, memory and processing capability to facilitate electronic representation of the game of the present invention on a display associated with the electronic device. Additionally, the word-based game of the present invention can be provided as a primary ticket game, or as a bonus or second chance game. For instance, a player may play a different lottery ticket as a base game, and then play the game disclosed herein as a bonus or second chance game. The additional game can be played as a physical ticket or electronically. In various embodiments, a base ticket game can be played and a code can be provided for use with an online game made available over a network such as the Internet, for example. Once the player enters the code from the ticket into a suitable interface (such as a mobile communications device, personal computing device, etc.), the game of the present invention can be provided for play.

In another aspect of the present invention, a method of providing a lottery game is provided. The method includes providing a ticket having potentially winnable prizes via a word-based game according to the various embodiments shown and described herein.

In embodiments of the present invention, a game can be provided as a combined instant win/draw-based game in various forms. Players can purchase individual tickets for the game at a lottery retailer, which can be in-person or over a network such as the Internet. Tickets are generated by a back-end host system as described herein. The system produces randomly determined words and indicia, subject to the conditions described above, and prints or displays them on the ticket/virtual ticket, and then the system subsequently conducts a drawing for winning letters to be compared to the words provided on the ticket. The letters can be pre-printed under a scratch-off coating on a physical ticket, for example, or revealed in various fashions in an electronic version of the game.

Figure 3:
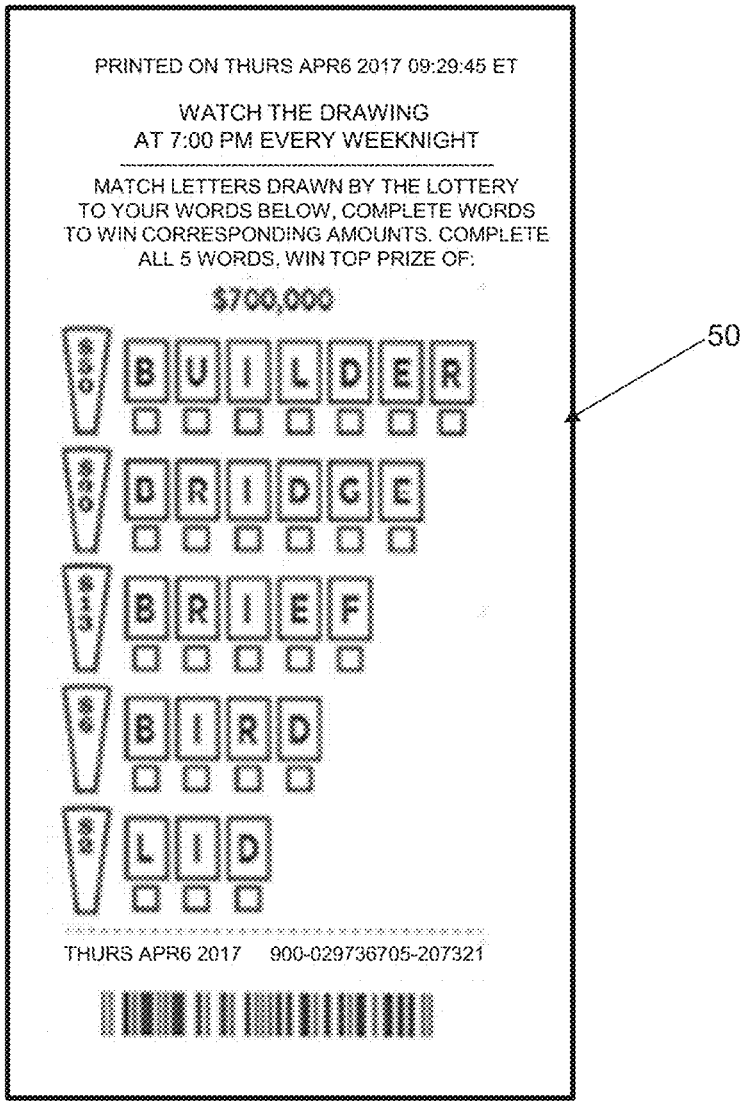
FIG. 3 illustrates a ticket produced according to an embodiment of the present invention.
Figure 4:
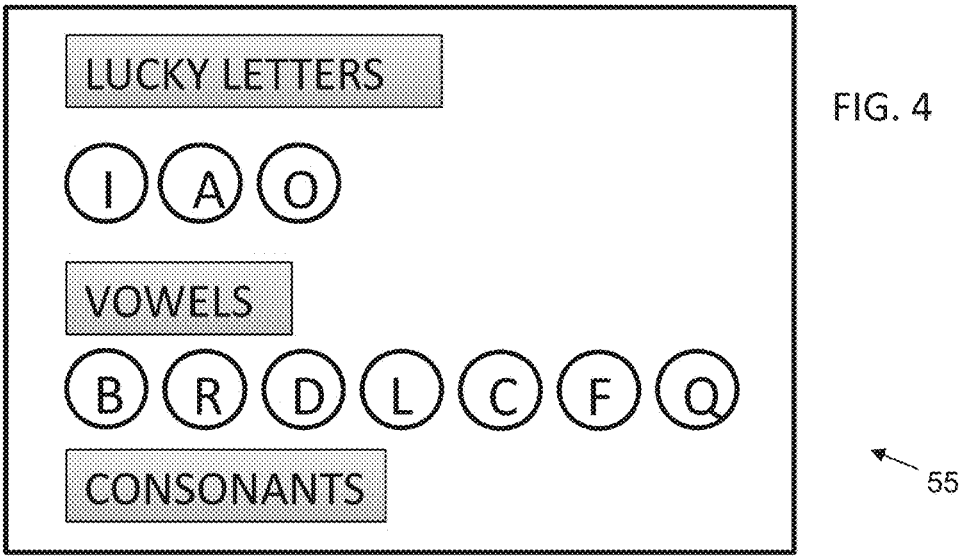
FIG. 4 illustrates exemplary letters drawn as part of a game associated with the present invention.
Figure 5:
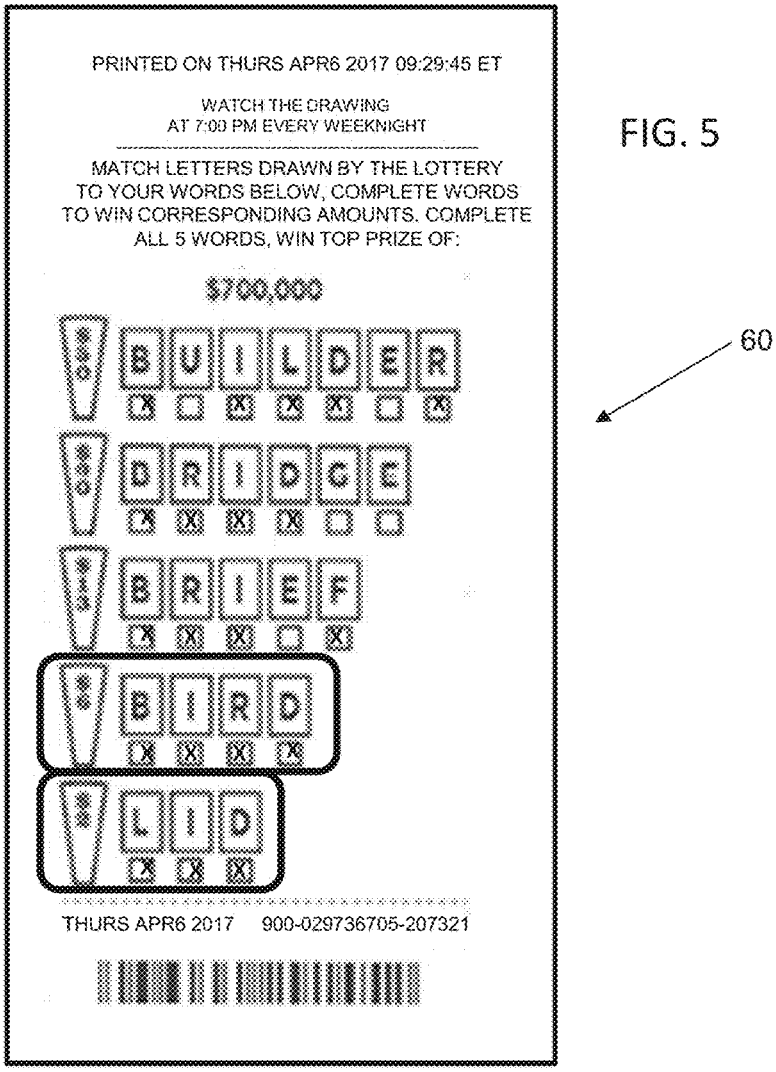
FIG. 5 shows the ticket of FIG. 3 with encircled matches based on the letters drawn in FIG. 4.

In the embodiment of a ticket 50 according to the present invention as shown in FIG. 3, a player can purchase a "quick pick" ticket with five randomly generated words. Each word can be assigned a prize value based on word length. For example, a seven-letter word prize value could range anywhere from $30 to $65. The draw in this embodiment can consist of drawing nine consonants (out of twenty-one in the alphabet) and three vowels (out of five in the alphabet). If a player completes a word using the lottery's drawn letters, he/she wins the prize associated with that word. Players can win multiple prizes on one ticket for matching more than one word. If a player completes all of the words on the ticket, the player wins the top prize. Each letter drawn covers all instances of that letter on a ticket. FIG. 4 shows the drawn letters at 55. In various embodiments, the drawn letters can be provided via various known communication means, including television networks, radio, telephone, satellite, cable and private and public networks, including the Internet, for example. Based on the drawn letters, the player in this example ticket has completed the words 'BIRD' and 'LID', and won a total prize of $11 ($8 and $3 respectively), as shown in marked ticket 60. Since the player did not match all of the words, the player does not win the top prize in this embodiment.

Figure 6:
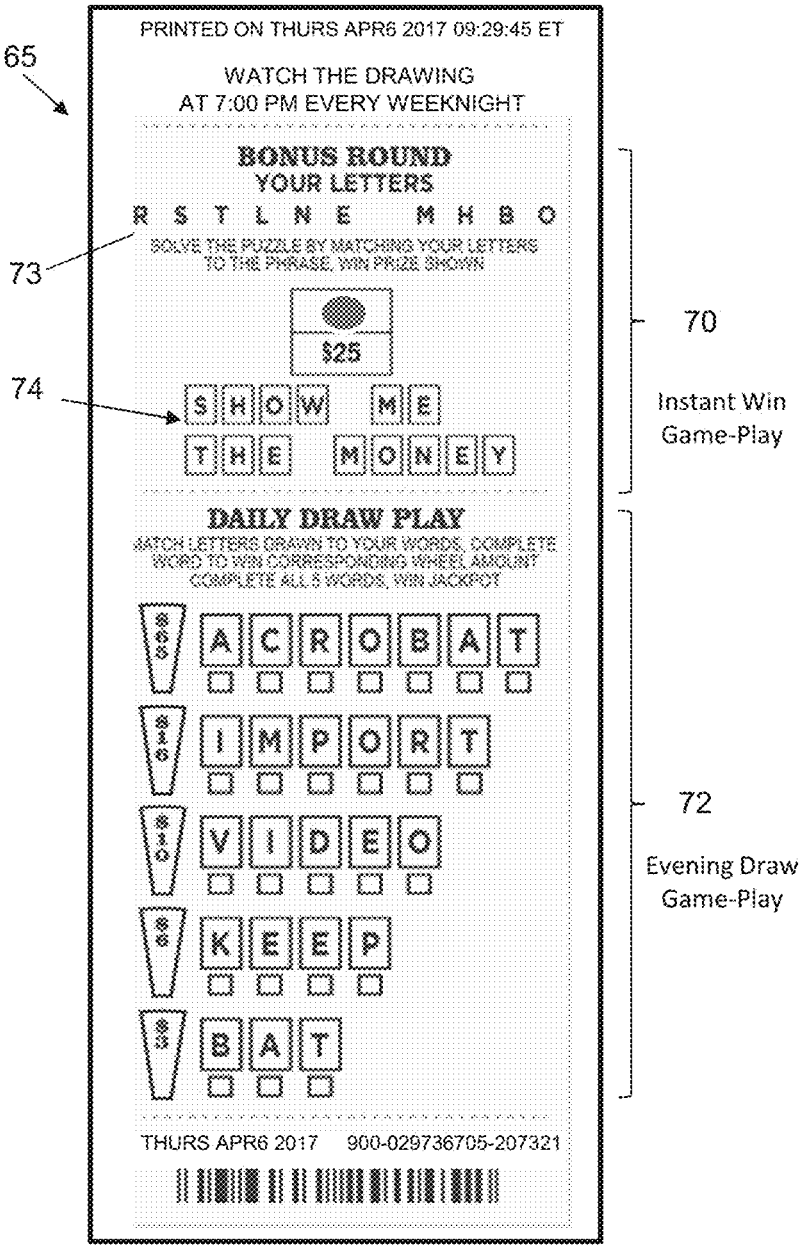
FIGS. 6 and 7 illustrate tickets produced according to embodiments of the present invention.

FIG. 6 illustrates another example ticket 65 for a draw-based game with an instant win component in accordance with various embodiments of the present invention. As shown therein, the ticket includes an instant win game-play at 70 and a draw game-play at 72. In various embodiments, the player must await the drawing for the draw-based game, which can occur in a traditional lottery drawing style, or via other mechanisms such as during a television game show, for example. In ticket 65, the instant win game is played using the letters provided randomly as "Your Letters" at 73, wherein the player tries to match the letters in all of the words shown at 74.

Figure 7:
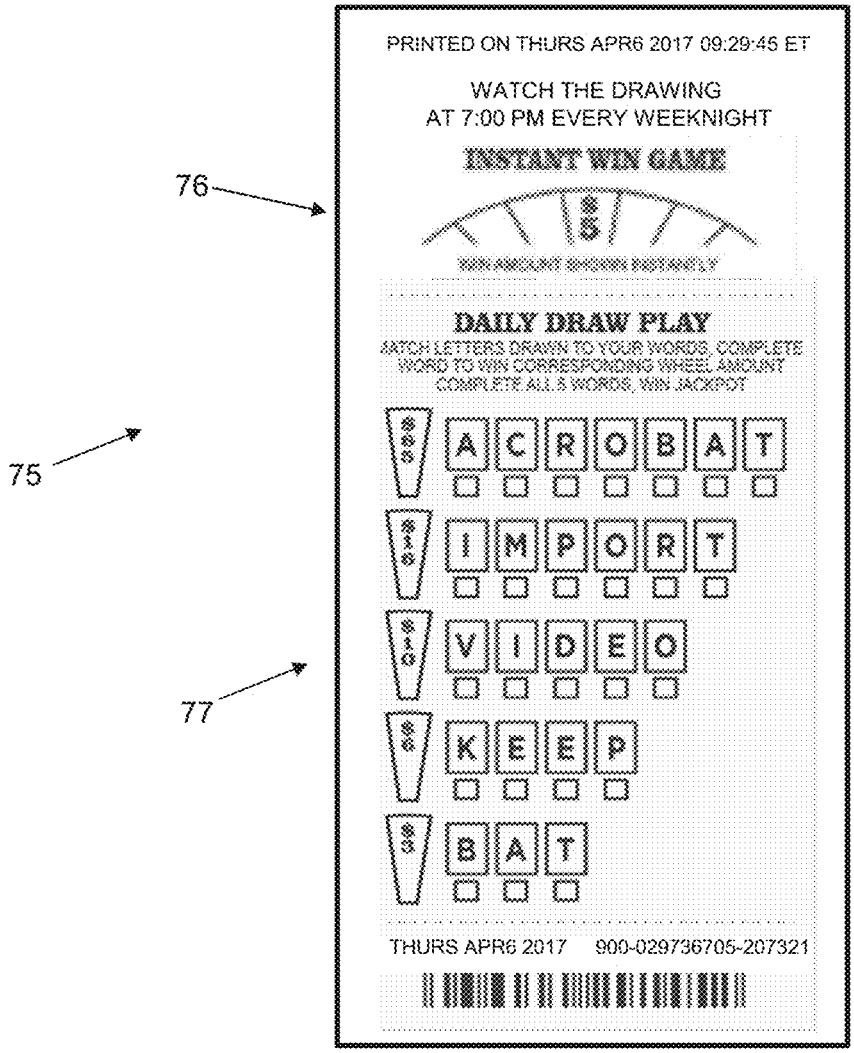

FIG. 7 illustrates another example ticket 75 for a draw-based game with an instant win component in accordance with various embodiments of the present invention. As shown therein, a player can ask retailer to purchase a themed ticket, such as a Wheel of Fortune™ draw ticket 75. Each ticket 75 in this embodiment contains an instant win bonus round puzzle on the top section 76 of the ticket 75, which can be played immediately upon purchase in various embodiments. Each ticket 75 in this embodiment further contains five randomly generated words on the bottom section 77 of the ticket, which can be matched to the letters drawn by the lottery in the evening draw, for example. In the ticket shown, the player won $5 instantly on the top instant game. A suitable prize pay table 78 for the instant game and a suitable prize pay table 79 for the draw-based game can be provided, with appropriate odds, prize ranges, average prizes and payout percentages, as shown in FIGS. 8 and 9, respectively.

Figure 10:
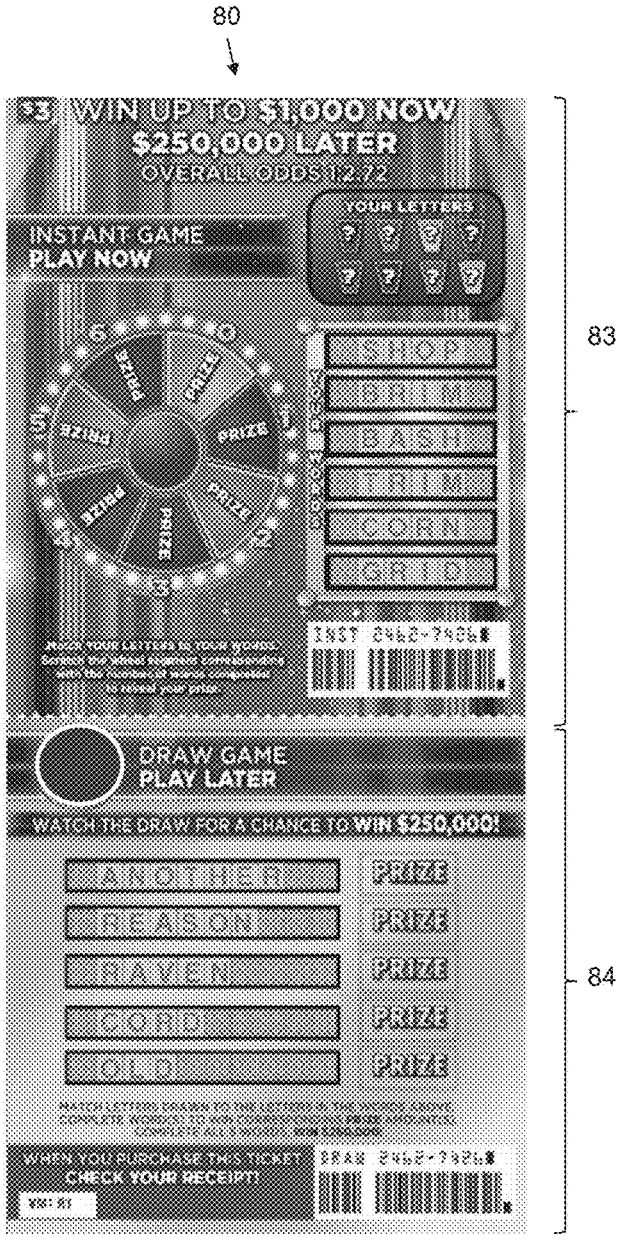
FIG. 10 illustrates an alternative ticket produced according to an embodiment of the present invention.
Figure 11:
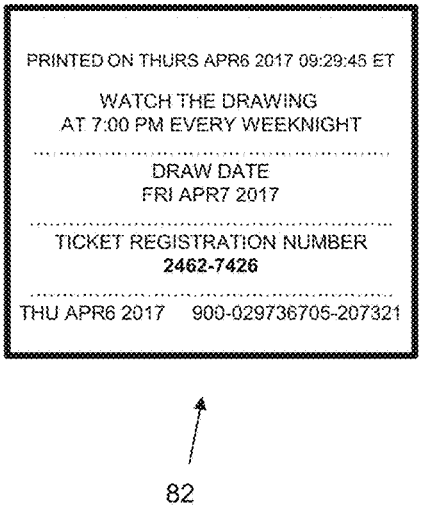
FIG. 11 shows an exemplary receipt associated with the ticket of FIG. 10.

FIG. 10 illustrates another example ticket 80 for a draw-based game with an instant win component in accordance with various embodiments of the present invention. As shown therein, a player can ask a retailer to purchase a themed ticket, such as a Wheel of Fortune™ ticket 80 from an instant ticket bin space. The retailer will then scan the ticket and provide the player with a "proof of purchase" receipt (82 in FIG. 11) as proof that the evening draw portion of the ticket is eligible. The top section 83 of the ticket 80 is the instant game-play (which can be played immediately upon purchase) and the bottom section 84 of the ticket 80 is to be played using the evening draw letters. Players can scratch to reveal each word's prize value and complete words by matching to the letters drawn by the lottery in the evening draw.

Figure 12:
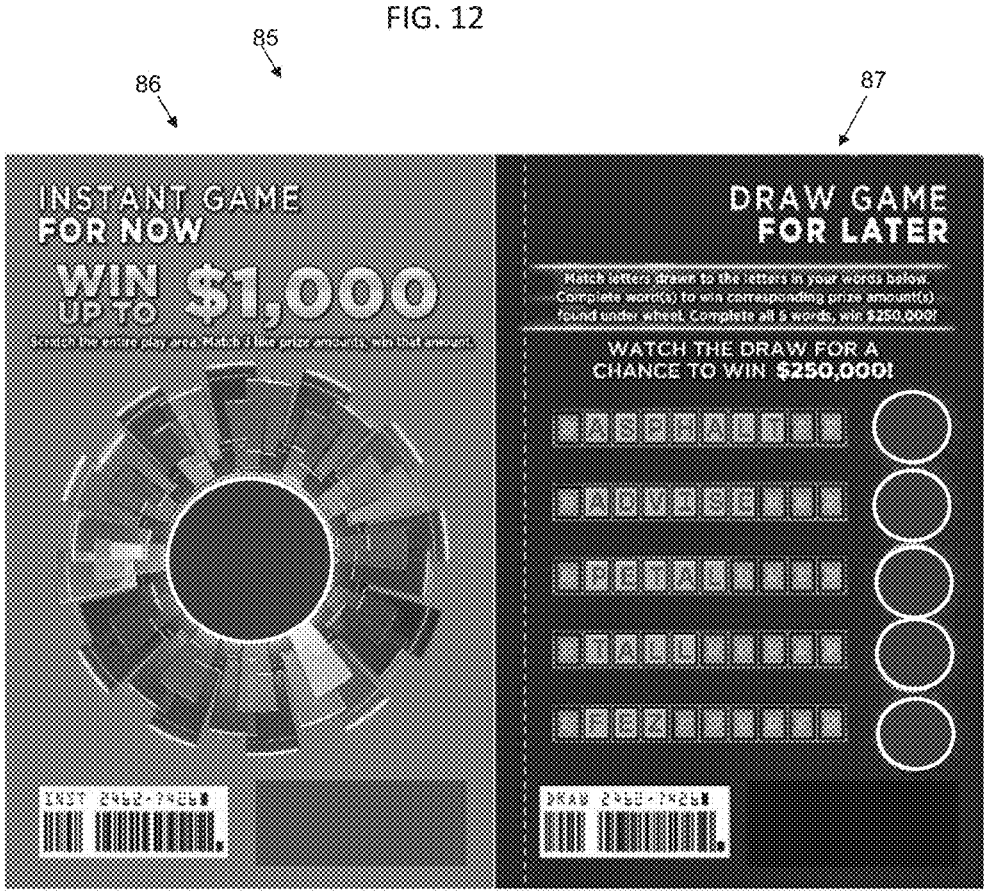
FIG. 12 illustrates an alternative ticket produced according to an embodiment of the present invention.

FIG. 12 illustrates another example ticket 85 for a draw-based game with an instant win component in accordance with various embodiments of the present invention. A player can ask a retailer to purchase a themed ticket, such as a Wheel of Fortune™ ticket 85 from an instant ticket bin space. The retailer will then scan the ticket and provide the player with a "proof of purchase" receipt as proof that the evening draw portion of the ticket is eligible. The left section 86 of the ticket 85 is the instant game-play (which can be played immediately upon purchase) and the right section 87 of the ticket 85 is to be played using the evening draw letters. Players can scratch to reveal each word's prize value and complete words by matching to the letters drawn by the lottery in the evening draw).

Figure 13:
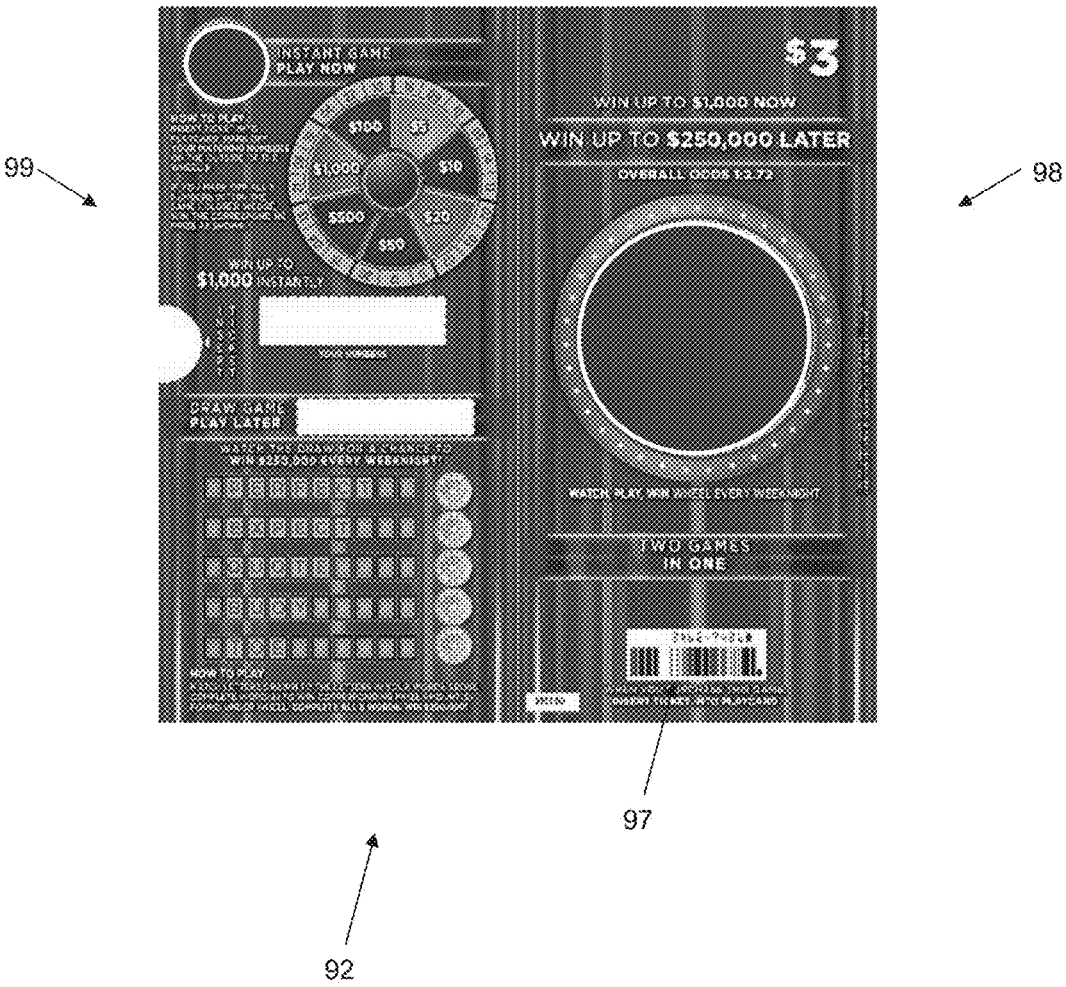
FIGS. 13 through 15 illustrate other exemplary tickets produced according to embodiments of the present invention.
Figure 14:
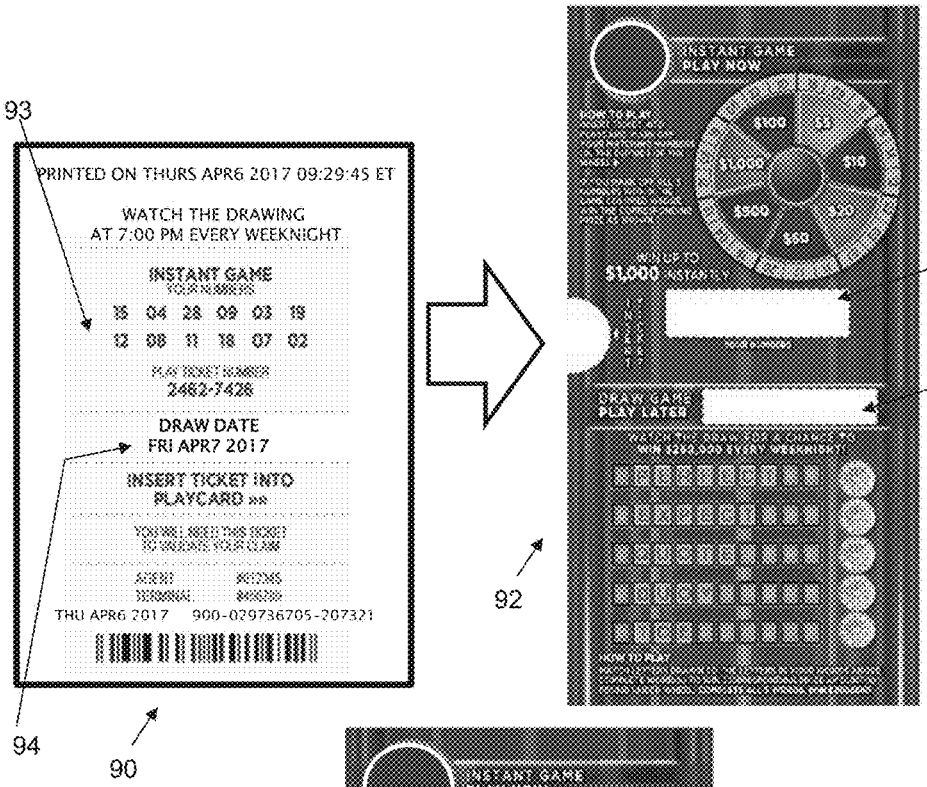
Figure 15:
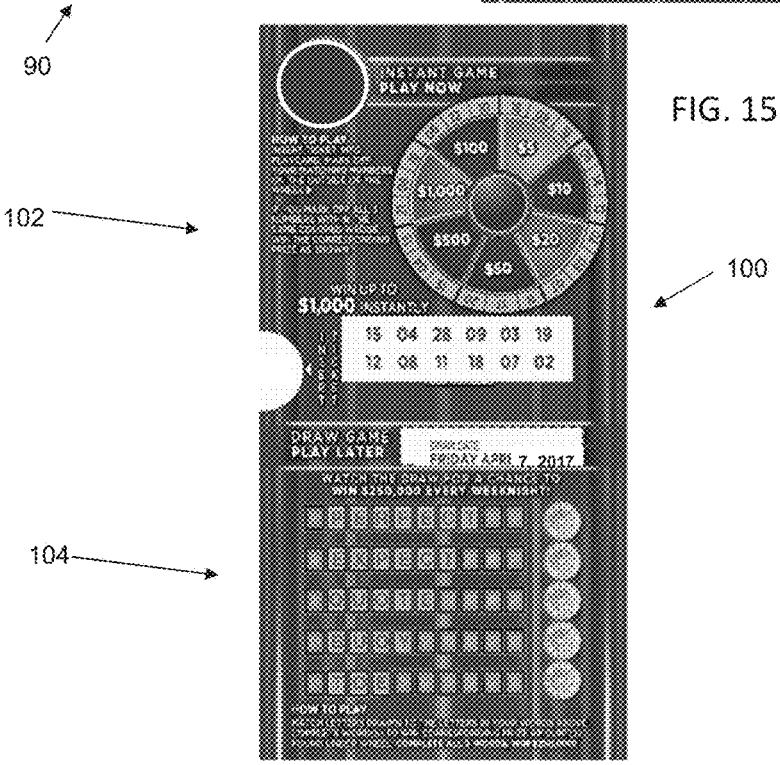

FIGS. 13 through 15 illustrate another example form of ticket 90 with an envelope 92 for a game in accordance with various embodiments of the present invention. The envelope 92 can include a front side 98 and a back side 99, as shown in FIG. 13. A player can select a themed game, such as a Wheel of Fortune™ Pick N' Play envelope 92 from the counter of a retail location. To purchase, the retailer will scan the Pick N' Play envelope 92 (such as by scanning a code 97 thereon) and provide the player with a "proof of purchase" receipt/ticket 90 which contains the winning instant game numbers 93 and the draw date 94 for the Pick N' Play envelope 92, as shown in FIG. 14. The player can insert the receipt/ticket 90 into the envelope as shown in FIG. 14. The top section 102 of the combined ticket/envelope (100 in FIG. 15) is the instant game-play (which can be played immediately upon purchase using the winning numbers on the receipt received which are shown through the die-cut opening 105) and the bottom section 104 of the combined ticket/envelope 100 is to be played using the evening draw letters. The draw date 94 is also shown through a die-cut opening 106 in the envelope 92. Players can scratch to reveal each word's prize value and scratch the letters as they are drawn, in various embodiments of this aspect of the present invention.

Figure 16:
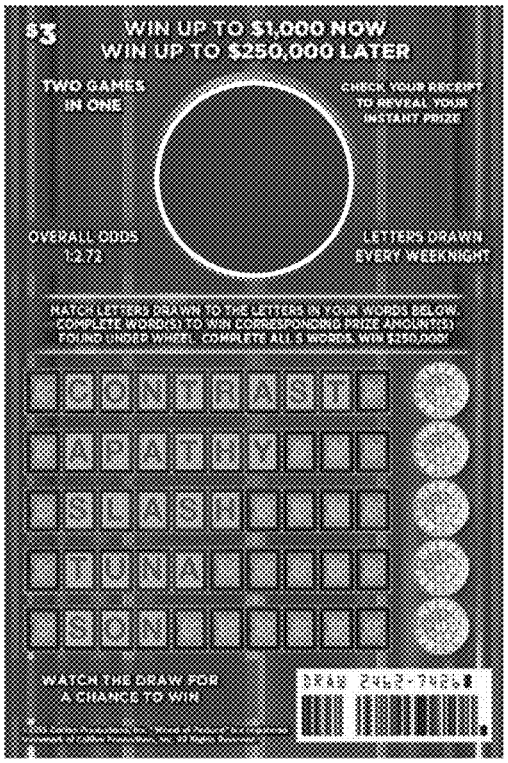
FIGS. 16 through 18 illustrate exemplary tickets and receipts for a draw-based game with an instant win component in accordance with various embodiments of the present invention.
Figure 17:
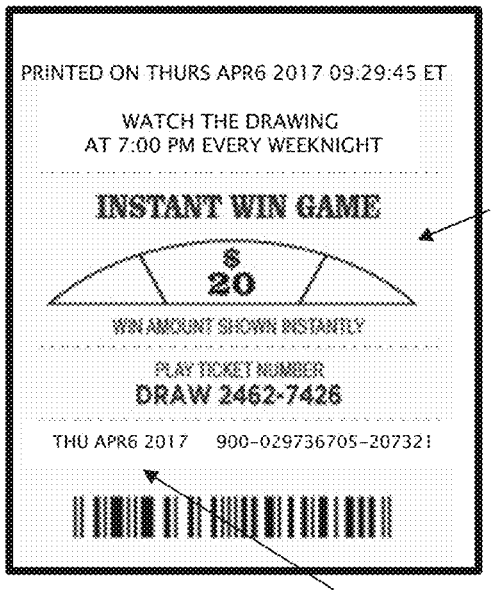

FIGS. 16 and 17 illustrate another example ticket 110 for a draw-based game with an instant win component in accordance with various embodiments of the present invention. Players can purchase a themed game such as a Wheel of Fortune™ Pick N' Play card from the counter of a retail location. To purchase, the retailer will scan the Pick N' Play card and provide the player with a "proof of purchase" receipt 111 as shown in FIG. 17, wherein the receipt contains an instant win result 112 and the draw date 114 for the Pick N' Play card. Players can scratch to reveal each word's prize value and scratch the letters as they are drawn.

Figure 18:
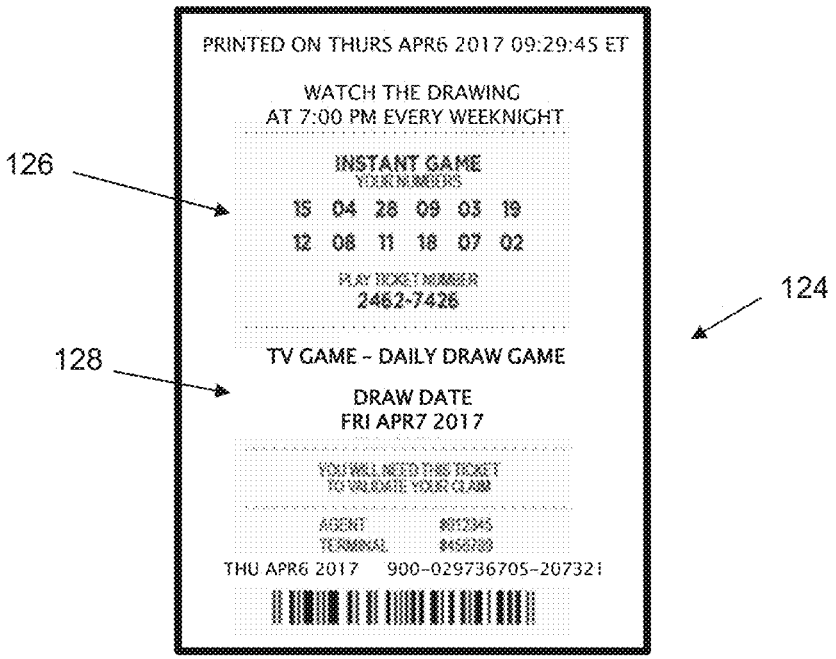

In various embodiments, players can purchase a themed game, such as a Wheel of Fortune™ Pick N' Play three-fold card, from the counter of a retail location, wherein the themed game is for a draw-based game with an instant win component in accordance with various embodiments of the present invention. To purchase, the retailer will scan the Pick N' Play card and provide the player with a "proof of purchase" receipt 124 as shown in FIG. 18, wherein the receipt contains instant win game numbers 126 and the draw date 128 for the Pick N' Play card. Players can scratch to reveal each word's prize value and scratch the letters as they are drawn.

In carrying out the above, it will be appreciated that the host computer system of the present invention can comprise a computer-based system, where the components can be implemented in hardware, software, firmware, or combinations thereof.

Users of electronic ticket embodiments of the present invention can access the system of the present invention using client computing devices, such as desktop computers, laptop computers and mobile communications devices (MCDs), for example. It will be appreciated that the system of the present invention can incorporate necessary processing power and memory for storing data and programming that can be employed by the processor(s) to carry out the functions and communications necessary to facilitate the processes and functionalities described herein. Each client computing device can be configured to communicate with an application server (not shown) associated with the host in the electronic ticket embodiments of the system described herein. Appropriate encryption and other security methodologies can also be employed by the system of the present invention, as will be understood to one of ordinary skill in the art. In the paper-based ticket embodiments of the present invention, the game host is in communication with ticket printers and client equipment (e.g., ticket vendor terminals, ticket kiosks as noted above) associated with the present invention.

Figure 19:
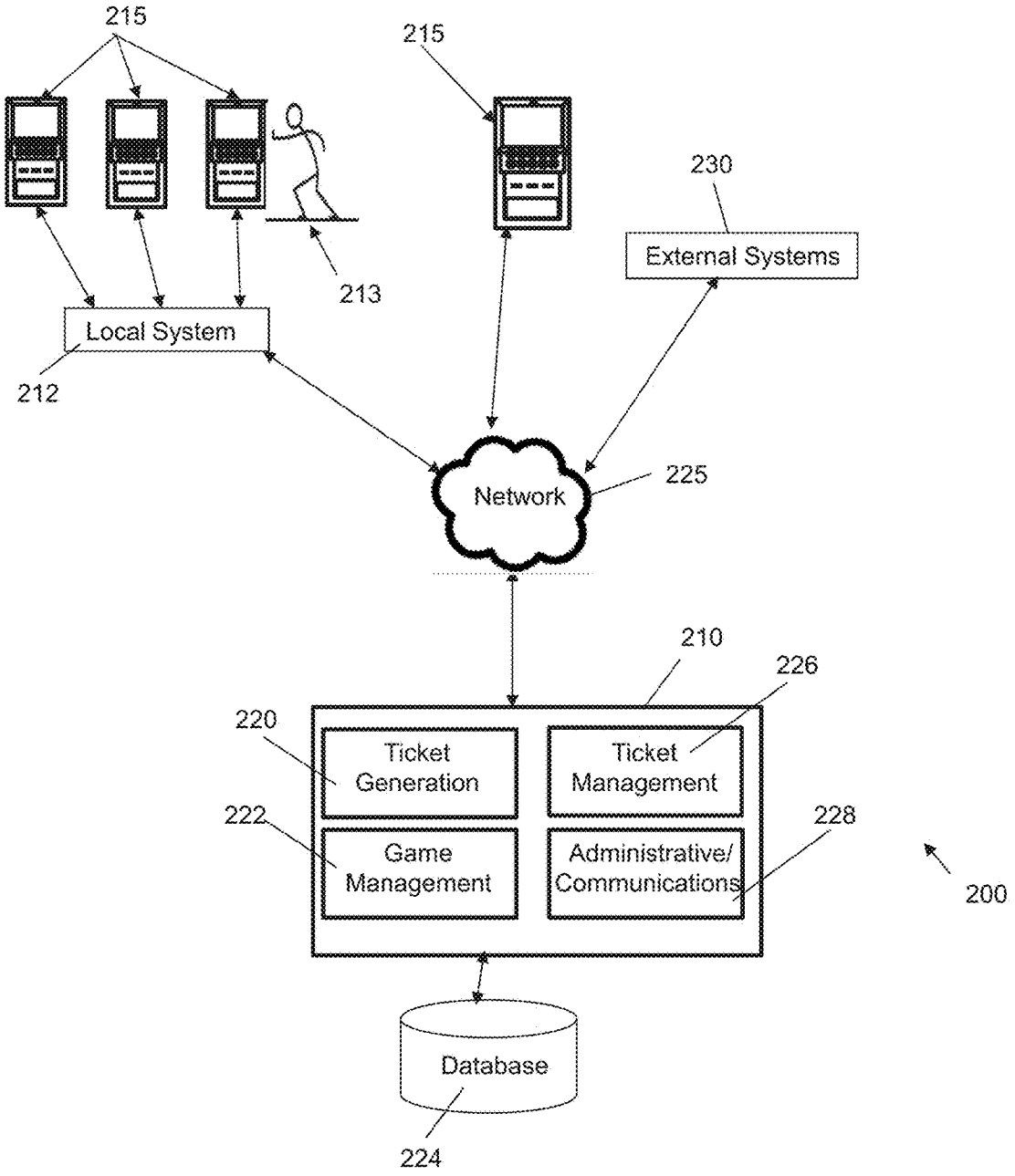
FIG. 19 is a sample schematic diagram illustrating components associated with embodiments of the present invention.

FIG. 19 is a schematic diagram illustrating an exemplary system 200 for facilitating processes and actions in accordance with embodiments of the present invention. As shown therein, embodiments of aspects of the system can comprise a computer-based game host system including a remote central controller 210, including components and/or modules that can be implemented in hardware, software, firmware, or combinations thereof. FIG. 19 illustrates an exemplary high-level network 225 with exemplary users 213 and/or external computer systems 215 that can interact with the controller 210 of the present invention. The users 213, e.g., retail clerks or game ticket purchasers, can access the system of the present invention using client computing devices 215, such as desktop computers, laptop computers, mobile communications devices (MCDs), retail ticket dispensers, retail point-of-sale terminals, smart television appliances or one or more public, self-serve game terminals or kiosks in appropriate commercial sites, subject to any jurisdictional limitations, for example. It will be appreciated that system 200 can be deployed with direct connections from central controller 210 to a device 215 via network 225, or indirect connection through a local computing system 212. It will be appreciated that the system of the present invention, including the components and modules described herein, can incorporate necessary processing power and memory for storing data and programming that can be employed by the processor to carry out the functions and communications necessary to facilitate the processes and functionalities described herein.

Users can enter commands and information into respective client computing devices through a user interface including traditional input mechanisms, such as a keyboard and pointing device, commonly referred to as a mouse, trackball or touch pad. Other input devices can include, for example, a microphone, joystick, game pad, satellite dish, scanner, voice recognition device, keyboard, touch screen, coin or bill slot, toggle switch, pushbutton, gesture based motions or the like. These input devices can be considered to comprise a wager input component for the device. One or more monitors or display devices can be provided with the computing device or game terminal 215 as will be understood in the art. In addition to display devices, the computing devices can also include other peripheral output devices, such as one or more printers, for example, which may be connected through an output peripheral interface. The printer and/or display screen can be considered to comprise a ticket output component. The wager input component receives a request for an acceptable wager and the ticket output component produces a ticket corresponding to an acceptable wager as described herein. The computers implementing the invention may operate in a networked environment using logical connections to one or more remote computers, the remote computers typically including many or all of the elements described above. Processing of actual transaction requests can occur at the central controller 210, locally at a device 215, or remotely at another controller associated with transaction and wager processing, and such processing can include any loyalty and related player account details, for example.

As further shown in FIG. 19, the system 200 can include a ticket generation module 220, a game management module 222, a ticket management module 226, and an administrative/communications module 228, and further can be coupled to one or more databases 224 and/or other data sources. The game management module 222 assists in establishing a desirable odds profile for a given game or game framework, establishing word length and word count parameters, establishing a dictionary of acceptable words, and establishing whether one or more duplicate letter combinations are permitted, for example. The ticket generation module 220 operates to generate acceptable tickets and/or wagers according to the processes described herein, wherein the tickets can be generated on-the-fly (e.g., as requested), or in advance of receiving a wager request. For example, the ticket generation module 220 can search through possible ticket outcomes given the game's word length and word count parameters, and the acceptable dictionary, and can further filter out repeated letter string combinations based on the number of permitted duplicates, for example. In various embodiments, the ticket generation module 220 and game management module 222 can communicate directly with one or more ticket printers to generate printed tickets according to the data provided by modules 220 and 222. In various embodiments, tickets can be printed with player words to be matched based on an independently viewed event, such as a drawing or television program as illustrated and described in the sample ticket 65 of FIG. 6. In various other embodiments, tickets can be printed with player words to be matched with pre-determined letters appearing directly or indirectly on the ticket itself. For example, the pre-determined call letters can appear under a scratch-off coating, or a code can be printed on the ticket that, when imaged by a reader device such as a mobile communications device with a camera, presents an animation that reveals the call letters to be matched to the letters in the words on the player's ticket. Such a code can be a QR code, for example, and the animation can be a spinning wheel, a rotating sphere or other animation. In various other embodiments, tickets can be printed with player words to be matched based on pre-determined call letters revealed on an independently accessed website, such that the pre-determined call letters are revealed online to a specific user, and not publicly broadcast. In this embodiment, the ticket may be provided with a code, link and/or other details providing the ticket holder with the ability to access and obtain the revealed letters. The system can operate such that the user acquires a mobile device software application from a website, such as an external website making the mobile application available, where the mobile application is generated by the central server 210, for example. The mobile application can provide the user's mobile device with the ability to execute functions such as accessing revealed letters, or presenting an animation upon focusing the mobile device's camera on a code on the ticket.

The ticket management component 226 can operate to activate and/or validate individual tickets and/or entire ticket sets or groups of ticket sets, and stores un-activated, activated and validated ticket data in database 224. The ticket management component can further compare scanned validation codes with the database 224 of activated winning tickets during appropriate validation processes. Should the ticket management component 226 determine that a given validation code is valid and/or authentic for a given ticket, the system 210 can communicate with the appropriate terminal 215 that the code is approved, and the retail clerk and/or self-service terminal can pay the winnings to the player. In various embodiments, the system stores data corresponding to the validation indicia printed on the tickets in given ticket sets for given games, receives data corresponding to the reading (e.g., scanning) of ticket validation indicia, and subsequently records validated tickets associated with the validation indicia that has been read. The administrative/communications module 228 operates to permit suitable personnel to administrate games via the various components and functions described herein, including communications with external sources 230, such as any external operators of ancillary games that relate to ticket games associated with the system 210. For instance, if a third party system 230 is determining random letters for players to use in matching letters and words on their individual tickets, the system 210 can communicate with such external systems 230 to understand which letters have actually been generated and are valid letters for use in determining and validating winners.

The above modules 220, 222, 226 and 228 can be programmed or configured to communicate with one another and with the databases 224. Such components or modules can comprise, for example, software programming stored in memory in one or more databases to be executed by one or more processors to carry out the processes and functions described herein. The components or modules can be recorded on a non-transitory computer-readable medium. The system of the present invention can execute these software modules to facilitate production, activation and validation of the lottery-type games and processes in accordance with embodiments of the present invention as described herein. The databases 224 can hold records related to tickets produced, tickets activated, tickets redeemed, players and games, including winning combinations, player selections, player and group rules, game presentations and functions and other information and functions.

Unless otherwise stated, devices or components of the present invention that are in communication with each other do not need to be in continuous communication with each other. Further, devices or components in communication with other devices or components can communicate directly or indirectly through one or more intermediate devices, components or other intermediaries. Further, descriptions of embodiments of the present invention herein wherein several devices and/or components are described as being in communication with one another do not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed general purpose computers and computing devices, for example. In this regard, at least one processor (e.g., a microprocessor or controller device) receives instructions from a memory or like storage device that contains and/or stores the instructions, and the at least one processor executes those instructions, thereby performing a process defined by those instructions. Further, programs that implement such methods and algorithms can be stored and transmitted using a variety of known media.

Common forms of computer-readable media that may be used in the performance of the present invention include, but are not limited to, floppy disks, flexible disks, hard disks, magnetic tape, any other magnetic medium, CD-ROMs, DVDs, any other optical medium, punch cards, paper tape, any other physical medium with patterns of holes, RAM, PROM, EPROM, FLASH-EEPROM, any other memory chip or cartridge, or any other medium from which a computer can read. The term "computer-readable medium" when used in the present disclosure can refer to any medium that participates in providing data (e.g., instructions) that may be read by a computer, a processor or a like device. Such a medium can exist in many forms, including, for example, non-volatile media, volatile media, and transmission media. Non-volatile media include, for example, optical or magnetic disks and other persistent memory. Volatile media can include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications.

Various forms of computer readable media may be involved in carrying sequences of instructions to a processor. For example, sequences of instruction can be delivered from RAM to a processor, carried over a wireless transmission medium, and/or formatted according to numerous formats, standards or protocols, such as Transmission Control Protocol/Internet Protocol (TCP/IP), Wi-Fi, Bluetooth, GSM, CDMA, EDGE and EVDO.

Where databases are described in the present disclosure, it will be appreciated that alternative database structures to those described, as well as other memory structures besides databases may be readily employed. The descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art.

It will be apparent to one skilled in the art that any computer system that includes suitable programming means for operating in accordance with the disclosed methods also falls well within the scope of the present invention, including such systems as may be offered in a cloud computing environment. Suitable programming means include any means for directing a computer system to execute the steps of the system and method of the invention, including for example, systems comprised of processing units and arithmetic-logic circuits coupled to computer memory, which systems have the capability of storing in computer memory, which computer memory includes electronic circuits configured to store data and program instructions, with programmed steps of the method of the invention for execution by a processing unit. Aspects of the present invention may be embodied in a computer program product, such as a diskette or other recording medium, for use with any suitable data processing system. The present invention can further run on a variety of platforms, including Microsoft Windows™, Linux™, Sun Solaris™, HP/UX™, IBM AIX™ and Java compliant platforms, for example. Appropriate hardware, software and programming for carrying out computer instructions between the different elements and components of the present invention are provided.

The present disclosure describes numerous embodiments of the present invention, and these embodiments are presented for illustrative purposes only. These embodiments are described in sufficient detail to enable those skilled in the art to practice the invention embodiments, and it will be appreciated that other embodiments may be employed and that structural, logical, software, electrical and other changes may be made without departing from the scope or spirit of the present invention. Accordingly, those skilled in the art will recognize that the present invention may be practiced with various modifications and alterations. Although particular features of the present invention can be described with reference to one or more particular embodiments or figures that form a part of the present disclosure, and in which are shown, by way of illustration, specific embodiments of the invention, it will be appreciated that such features are not limited to usage in the one or more particular embodiments or figures with reference to which they are described. The present disclosure is thus neither a literal description of all embodiments of the invention nor a listing of features of the invention that must be present in all embodiments.

The invention claimed is:

1. A ticket generation system comprising:

at least one computer storage device containing game detail data including one or more of: a list of acceptable words, a count of draw-able consonants, a count of draw-able vowels, a number of words, and a length of each of the number of words; and at least one processor coupled to the computer storage device and programmed to:

identify, based on the stored game detail data, a plurality of potential tickets, wherein each potential ticket comprises at least a group of words;

for a first potential ticket of the plurality of identified potential tickets, determine a first acceptable wager comprising a first group of words and a first represented letter combination corresponding to the first group of words, wherein the first represented letter combination is based on at least one of the groups of words of the plurality of identified potential tickets and the first represented letter combination comprises a first plurality of individual letters; and for each additional potential ticket of the plurality of identified potential tickets:

determine at least one additional letter combination corresponding to a group of words associated with that additional potential ticket compared against at least the first represented letter combination for the first potential ticket, wherein the determined at least one additional letter combination is based on at least one of the groups of words of the plurality of identified potential tickets and the determined at least one additional letter combination comprises a plurality of individual letters; and responsive to the determined at least one additional letter combination corresponding to the group of words for that additional potential ticket not being the same as, or being within an allowable number of duplicates of, the first represented letter combination for the first potential ticket, store that additional potential ticket as an additional acceptable wager available for distribution by a ticket output device.

2. The ticket generation system of claim 1, wherein the plurality of potential tickets are identified prior to a wager being placed.

3. The ticket generation system of claim 1, wherein an individual acceptable wager for a potential ticket of the plurality of potential tickets is determined as a wager is placed.

4. The ticket generation system of claim 1, wherein the at least one processor is programmed to check that each acceptable word on a potential ticket requires an appropriate numbers of vowels and consonants.

5. The ticket generation system of claim 1, wherein the at least one processor is programmed to remove any of the potential tickets having an undesirable odds profile.

6. The ticket generation system of claim 1, wherein the first acceptable wager and any additional acceptable wagers are stored in the at least one computer storage device.

7. The ticket generation system of claim 1, wherein a set of the plurality of potential tickets are associated with a set of printed game tickets available for distribution, the set of printed game tickets comprising at least a first ticket with the first group of words associated with the first acceptable wager printed thereon, and at least one additional ticket with a group of words associated with an additional acceptable wager printed thereon.

8. A method of operating a ticket generation system, the method comprising:

establishing, by a processor, and storing, by a computer storage device, game details, including one or more of: a list of acceptable words, a count of draw-able consonants, a count of draw-able vowels, a number of words, and a length of each of the number of words;

identifying, by the processor and based on the stored game details, a plurality of potential tickets, wherein each potential ticket comprises at least a group of words;

for a first potential ticket of the plurality of identified potential tickets, determining, by the processor, a first acceptable wager comprising a first group of words and a first represented letter combination corresponding to the first group of words, wherein the first represented letter combination is based on at least one of the groups of words of the plurality of identified potential tickets and the first represented letter combination comprises a first plurality of individual letters; and for each additional potential ticket of the plurality of identified potential tickets:

determining, by the processor, at least one additional letter combination corresponding to a group of words associated with that additional potential ticket compared against at least the first represented letter combination for the first potential ticket, wherein the determined at least one additional letter combination is based on at least one of the groups of words of the plurality of identified potential tickets and the determined at least one additional letter combination comprises a plurality of individual letters; and responsive to the determined at least one additional letter combination corresponding to the group of words for that additional potential ticket not being the same as, or being within an allowable number of duplicates of, the first represented letter combination for the first potential ticket, storing, by the computer storage device, that additional potential ticket as an additional acceptable wager available for distribution by a ticket output device.

9. The method of claim 8, wherein the plurality of potential tickets are identified prior to a wager being placed.

10. The method of claim 8, further comprising determining an individual acceptable wager for a potential ticket of the plurality of potential tickets as a wager is placed.

11. The method of claim 8, further comprising checking that each acceptable word on a potential ticket requires an appropriate numbers of vowels and consonants.

12. The method of claim 8, further comprising removing any of the potential tickets having an undesirable odds profile.

13. The method of claim 8, further comprising storing, by the computer storage device, the first acceptable wager and any additional acceptable wagers.

14. The method of claim 8, wherein a set of the plurality of potential tickets are associated with a set of printed game tickets available for distribution, the set of printed game tickets comprising at least a first ticket with the first group of words associated with the first acceptable wager printed thereon, and at least one additional ticket with a group of words associated with an additional acceptable wager printed thereon.

15. A system comprising:

a remote central host comprising at least one processor and a memory storing instructions that, when executed by the at least one processor, cause the at least one processor to:

identify, based on stored game details, a plurality of potential game tickets, wherein each potential ticket comprises at least a group of words;

for a first potential ticket of the plurality of identified potential tickets, determine a first acceptable wager comprising a first group of words and a first represented letter combination corresponding to the first group of words, wherein the first represented letter combination is based on at least one of the groups of words of the plurality of identified potential tickets and the first represented letter combination comprises a first plurality of individual letters; and for each additional potential ticket of the plurality of identified potential tickets:

determine at least one additional letter combination corresponding to a group of words associated with that additional potential ticket compared against at least the first represented letter combination for the first potential ticket, wherein the determined at least one additional letter combination is based on at least one of the groups of words of the plurality of identified potential tickets and the determined at least one additional letter combination comprises a plurality of individual letters; and responsive to the determined at least one additional letter combination corresponding to the group of words for that additional potential ticket not being the same as, or being within an allowable number of duplicates of, the first represented letter combination for the first potential ticket, store that additional potential ticket as an additional acceptable wager; and at least one device communicatively coupled to the remote central host, the at least one device having a wager input component configured to receive a request for an acceptable wager and a ticket output component configured to produce a ticket corresponding to one of: the first acceptable wager and an additional acceptable wager.

16. The system of claim 15, wherein the potential game tickets pertain to a game involving matching randomly selected letters to pre-printed words on the ticket to determine if all of the letters of any of the pre-printed words match the randomly selected letters.

17. The system of claim 15, wherein the stored game details include one or more of: a list of acceptable words, a count of draw-able consonants, a count of draw-able vowels, a number of words, and a length of each of the number of words.

18. The system of claim 15, wherein the plurality of potential tickets are identified prior to a wager being placed.

19. The system of claim 15, wherein an individual acceptable wager for a potential ticket of the plurality of potential tickets is determined as a wager is placed.

20. The system of claim 15, wherein when executed by the at least one processor, the instructions cause the at least one processor to check that each acceptable word on a potential ticket requires an appropriate numbers of vowels and consonants.

21. The system of claim 15, wherein the stored game details include at least one code to be included on the ticket produced by the at least one device which further includes a reader device to read the code to produce call letters associated with at least one of the group of acceptable wagers.

22. The system of claim 16, wherein at least one of: a letter a letter combination is excluded from the randomly selected letters.

* * * * *